US005818181A

United States Patent [19]

Ballard

[11] Patent Number: 5,818,181

[45] **Date of Patent: *Oct. 6, 1998**

[54] NEON LAMP ISOLATION TRANSFORMER FOR MID-POINT COMMONED NEON LAMPS

[75] Inventor: Gerald L. Ballard, Brandon, Miss.

[73] Assignee: MagneTek, Inc., Nashville, Tenn.

[ * ] Notice: The term of this patent shall not extend beyond the expiration date of Pat. No. 5,751,523.

[21] Appl. No.: 752,646

[22] Filed: Nov. 19, 1996

[51] Int. Cl.[6] ..... H05B 41/16

[52] U.S. Cl. ..... 315/276; 315/278; 315/324; 315/257; 361/42; 361/35; 361/38

[58] Field of Search ..... 315/276, 278, 315/324, 225, 257, 282; 361/35, 38, 41, 42

[56] References Cited

U.S. PATENT DOCUMENTS

| | | | |
|---|---|---|---|
| 1,786,422 | 12/1930 | Daley | 336/165 |
| 3,666,993 | 5/1972 | Legatti | 317/18 |
| 4,507,698 | 3/1985 | Nilssen | 361/42 |
| 4,510,476 | 4/1985 | Clatterbuck | 336/84 |
| 4,734,828 | 3/1988 | Vargo | 363/22 |
| 5,090,048 | 2/1992 | Blake | 378/202 |
| 5,241,443 | 8/1993 | Efantis | 361/36 |

*Primary Examiner*—Benny T. Lee
*Assistant Examiner*—Haissa Philogene
*Attorney, Agent, or Firm*—Waddey & Patterson; Mark J. Patterson

[57] ABSTRACT

A low cost power supply with enhanced safety protection for neon lamps connected in a midpoint commoned lamp configuration. The power supply has a return path which is isolated from the earth ground so that a fault current does not flow from the output terminals to the earth ground. The windings are phased in a series opposing configuration such that the voltages between the output terminals sum to zero. This power supply of mid-point connected secondary coil design is capable of operating lamp lengths that typically require 15,000 volts of open circuit voltage while not exceeding 7500 volts to ground when any one output terminal is grounded.

11 Claims, 5 Drawing Sheets

NEON LAMP ISOLATION TRANSFORMER FOR MID-POINT COMMONED NEON LAMPS

CROSS REFERENCE TO RELATED APPLICATION

Cross-reference is made to a related U.S. patent application Ser. No. 08/715,873, now U.S. Pat. No. 5,751,523 titled, "Secondary Ground Fault Protected Luminous Tube Transformer for Mid-Point Connected Luminous Tubes", filed on Sep. 19, 1996 and assigned to the same assignee as the present invention of which Gerald L. Ballard, the inventor of the present invention is a co-inventor. The cross-referenced application concerns a ground fault protected neon transformer. This information is incorporated herein by this reference.

BACKGROUND OF THE INVENTION

This invention relates to isolation transformers used for supplying power to neon gas discharge lamps. More specifically, it relates to neon transformers which drive a lamp configuration that has two return paths. This tube configuration is referred to as a midpoint grounded or commoned lamp or luminous tube. The invention prevents hazardous conditions in which a current flows from the output terminals to ground.

Currently, in neon tube transformers that are being used the output voltage from one output terminal to ground cannot exceed 7500 volts. To provide a design capable of producing output voltages in excess of 7500 volts, a mid-point grounded secondary is employed in which two secondary coils are used. These coils produce voltages that are 180 degrees out of phase with each other. A voltage is developed then between the two secondary terminals that is twice that measured from any one terminal to ground. Thus a voltage of 15,000 volts is developed between the two secondary terminals. This higher voltage is required in order to operate longer lengths of neon tubing. The midpoint grounded transformer is constructed with one end of each secondary winding tied to a grounded common point. Additionally, the core of the transformer is tied with the grounded common point.

FIG. 1 shows a diagram of a prior art neon transformer with series tube connections. Referring to FIG. 1, transformer housing 10 contains a transformer T1 with primary winding TW3 and secondary windings TW1 and TW2. A source of AC power (not shown) supplies power to primary side terminals P1 and P2. Terminal P3 connects the windings TW1 and TW2 to ground. Core C1 is connected to ground through terminal GND. Secondary output terminals S1 and S2 are series connected to neon tubes B1, B2, B3 and B4 by wires W1 and W2. High voltage bushing insulators I1 and I2 surround terminals S1 and S2. During operation the transformer T1 steps up the voltage between S1 and S2 to a high enough voltage to strike and operate the neon tubes. Once the lamps have struck the leakage inductance of the transformer limits the current drawn by the neon tubes. The maximum allowable voltage between S1 or S2 and ground would be 7500 volts. This would result in a voltage between S1 and S2 of twice the terminal to ground voltage or 15,000 volts maximum. One problem with this prior art design is that the length of high voltage wires (W1 and W2) connecting between the secondary terminals S1 and S2 is lengthy and results in added costs. These high voltage wires have to be rated to withstand 7500 volts. That problem has been overcome with the prior art design shown in FIG. 2.

FIG. 2 shows a diagram of another prior art neon transformer. Referring to FIG. 2, the neon tube connections of FIG. 1 have been modified to a midpoint grounded tube configuration. Secondary output terminal S1 is connected to neon tube B2 by wire W1, tube B2 is connected to tube B1. Tube B1 is connected by wire W3 to ground terminal GND. Similarly, secondary output terminal S2 is connected to neon tube B3 by wire W2, tube B3 is connected to tube B4. Tube B4 is connected by wire W4 to ground terminal GND. This configuration minimizes the length of output wiring energized at a high voltage level. If the transformer is located close to the neon tubes, the length of high voltage wire W1 and W2 can be short. Wires W3 and W4 can be lengthy. With this design a high voltage fault can occur between the output leads and ground.

Neon luminous tubes typically are custom made for a particular application. As such their gas pressures, mixtures and amount of mercury introduced into the tube are quite variable. These different tube characteristics result in very non-uniform amounts of voltage and current drawn by each tube. Further, neon lamps contain a tungsten filament in each end of the lamp which is coated with an emissive material that has a lower work function than tungsten. As the lamps age, the emissive coating material on the filaments is worn away so that the arc must flow from the bare tungsten filament. The work function of the tungsten filament is high, so several watts of power are dissipated in the cathode fall region near the filament. This extra power dissipation means that one lamp will draw more power than others. When a lamp with a worn-out filament is operating with a high cathode fall voltage, the arc voltage increases. The arc voltage may become asymmetrical if one filament is more worn than the other. When using a midpoint grounded neon tube configuration with a mid-point grounded neon transformer, the current and power levels between each of the current paths (through lamp B1 and B2 or B3 and B4) can be expected to vary. They will rarely stay equal.

In order to increase the safety of utilizing such a high voltage, it is advantageous to protect property coming in contact with the transformer. Industry regulations have been proposed to require the use of secondary side protection. It is desirable for the transformer and the lamp when operating to be able to reliably control secondary faults such that fault paths from the secondary side to ground are not permitted to develop at any time.

The use of mid-point grounded neon transformers is well known in the art having been shown as illustrated by U.S. Pat. No. 1,786,422 to Daley. It shows a mid-point grounded transformer assembly for neon lamps. It does not show any isolation scheme. U.S. Pat. No. 3,666,993 shows a ground fault protection circuit for use with an isolated transformer. U.S. Pat. No. 4,510,476 shows a high voltage isolation transformer with electrostatic shields to prevent corona breakdown. U.S. Pat. No. 4,734,828 shows a high frequency neon power supply with a conventional midpoint grounded transformer. U.S. Pat. No. 5,090,048 discloses multiple isolated transformers for an X-ray machine. U.S. Pat. No. 5,241,443 shows a secondary ground fault protection circuit for use with a neon transformer. None of these patents shows using a midpoint grounded lamp or luminous tube configuration.

A currently unmet need exists for a simple and inexpensive isolated neon transformer for mid-point commoned tube connections that provides protection to enhance safety.

SUMMARY

An object of the invention is to provide a low cost power supply for neon lamps with enhanced safety protection.

Another object of the invention is to provide a power supply with a return path which is isolated from the earth ground so a fault current does not flow from the output terminals to the earth ground. Another object of the invention is to provide a power supply in which the windings are phased such that the voltages between the output terminals sum to zero. An object of the invention is to provide a midpoint connected terminal insulated from the housing and isolated from ground. Another object of the invention is to provide an isolated gas discharge tube or lamp power supply design with a mid-point tube connection feature that will not operate a series lamp connection. Still yet another object of the invention is to provide an isolated gas tube power supply of mid-point connected secondary coil design which is capable of operating lamp lengths that typically require 15,000 volts of open circuit voltage, that will not exceed a maximum allowable voltages to ground of 7500 volts when any one output terminal is grounded. Another object of the invention is to provide an isolated gas tube power supply design that satisfies industry requirements for secondary ground fault protection, while operating luminous tube footages that generally require 7500 volts to 15000 volts for proper operation.

A transformer assembly for powering gas discharge lamps. The lamps are connected in a midpoint commoned lamp configuration. The assembly has output terminals connected to the lamps. The output terminals provide a high voltage to the lamps. The assembly has a transformer with the transformer having a primary winding and a plurality of secondary windings. The secondary windings are connected to the output terminals. The secondary windings further have a midpoint terminal. The secondary windings are wound in a series opposing configuration. This results in the voltage between the output terminals having a magnitude of 0 volts. A housing contains the transformer and has input terminals connected to the primary winding which receive a source of power. A ground terminal is connected to an earth ground and to the housing. A return terminal is connected to the mid-point terminal and to the lamps and operates to provide a return path which is isolated from the earth ground such that a fault current does not flow from the output terminals to the earth ground.

BRIEF DESCRIPTION OF THE DRAWINGS

These and other features, aspects and advantages of the present invention will become better understood with regard to the following description, appended claims and accompanying drawings where:

DETAILED DESCRIPTION

Figure 1:
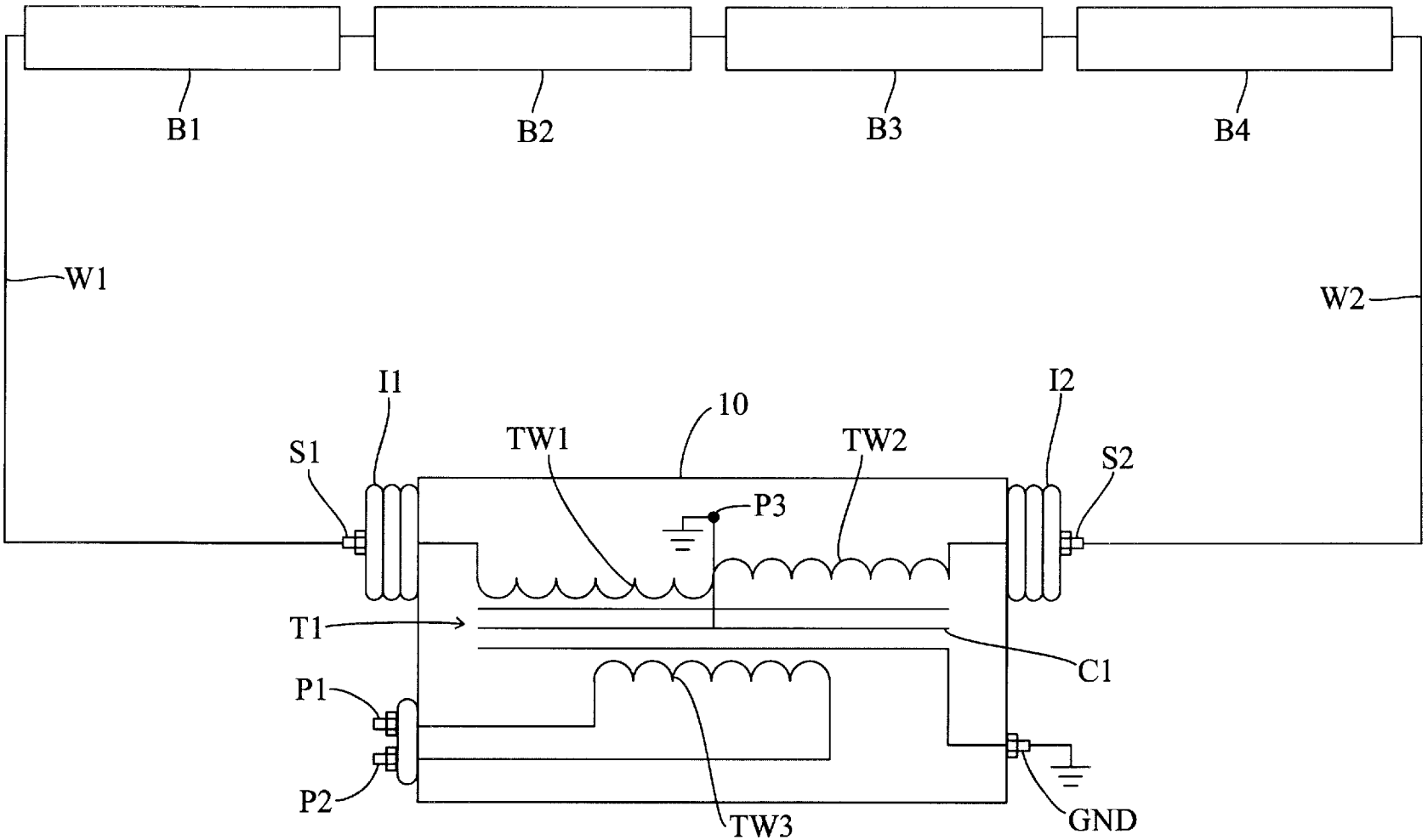
FIG. 1 (PRIOR ART)
FIG. 1 is a diagram of a prior art neon transformer and series lamp connection configuration.
Figure 2:
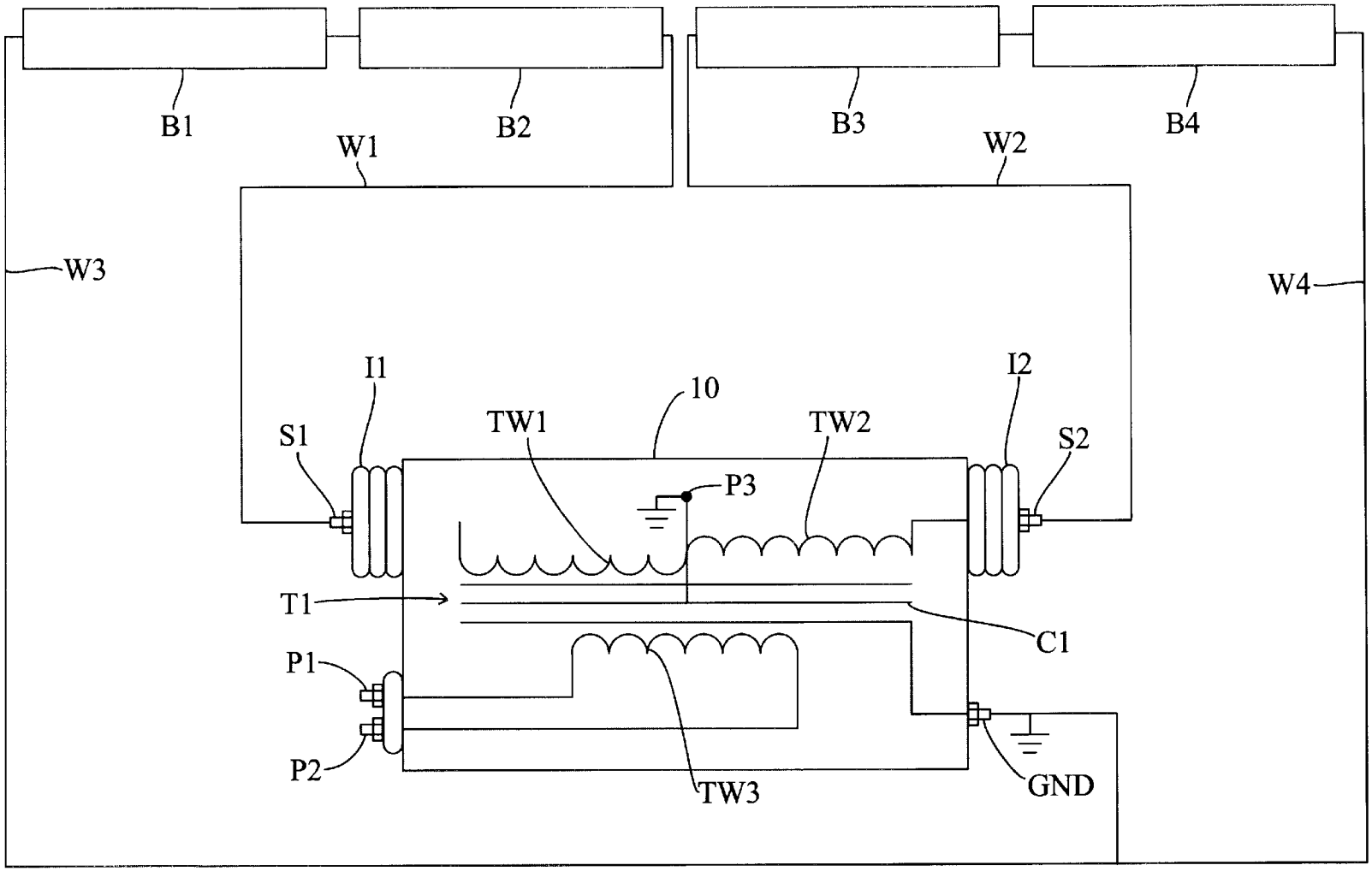
FIG. 2 (PRIOR ART)
FIG. 2 is a diagram of a prior art neon transformer and midpoint grounded lamp connection configuration with mid-point grounding of the transformer.
Figure 3:
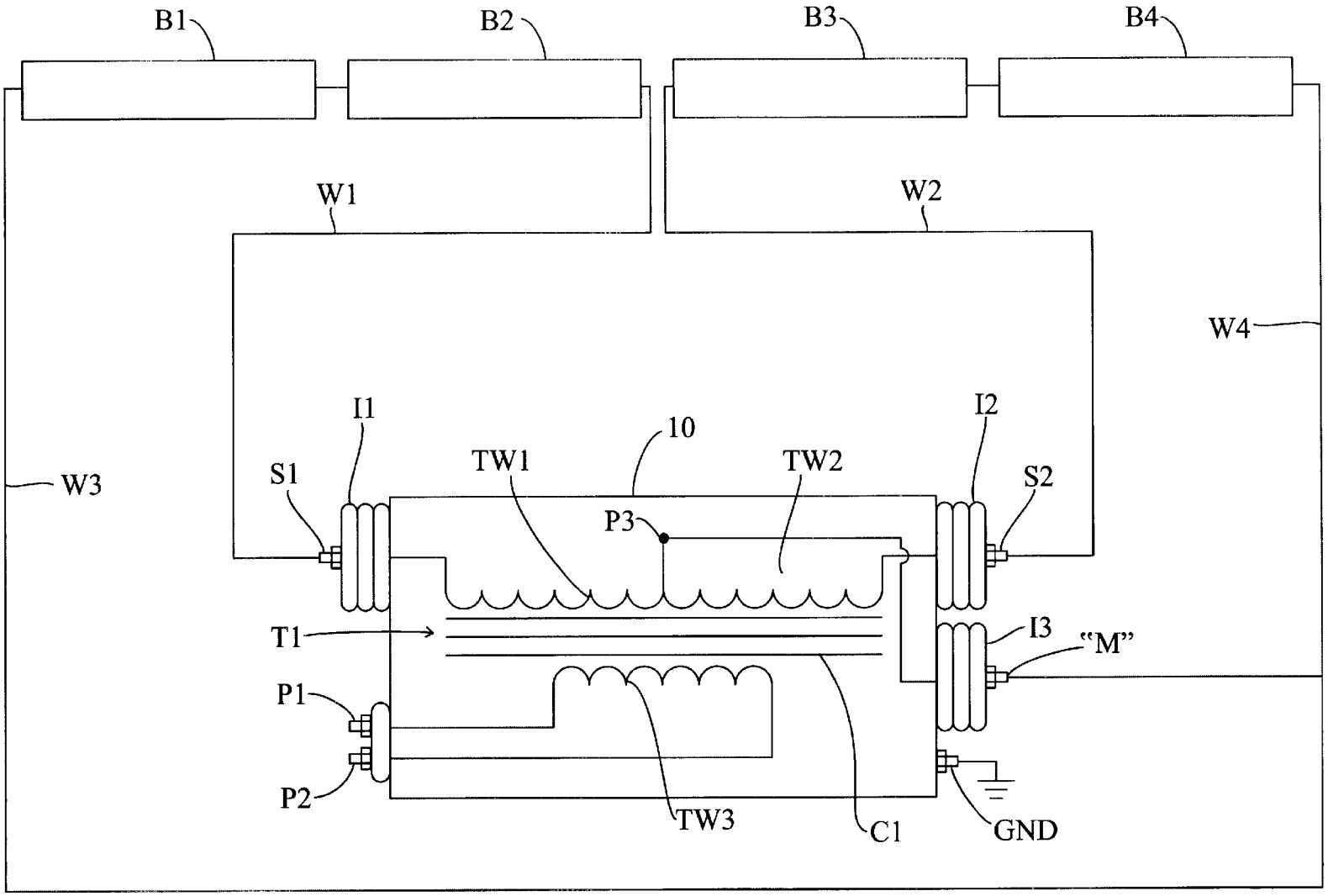
FIG. 3 is a diagram of the preferred embodiment of the present invention. It includes a mid point commoned neon lamp connection with an isolated transformer.

FIG. 3 shows the preferred embodiment of the invention. Referring to FIG. 3, a neon transformer and midpoint commoned lamp connection configuration with the addition of a return terminal M is shown. A return terminal M is connected to the midpoint terminal P3 of the transformer secondary. High voltage bushing insulator I3 surrounds terminal M. During normal operations the flow of current will be as shown by path 50. The current will flow for half of the cycle from terminal S2 through wire W2, neon tubes B3 and B4, through wire W4 to terminal M, terminal P3 and winding TW2 to complete the path. For the other half of the cycle the current flow will be reversed. Similarly, for tubes B1 and B2, the current will flow for half of the cycle from terminal S1 through wire W1, neon tubes B2 and B1, through wire W3 to terminal M, terminal P3 and winding TW1 to complete the path. Return terminal M is isolated from ground. Such an arrangement eliminates the possibility of creating a fault condition from the output terminals S1 or S2 to ground while using a midpoint commoned tube connection.

Figure 4:
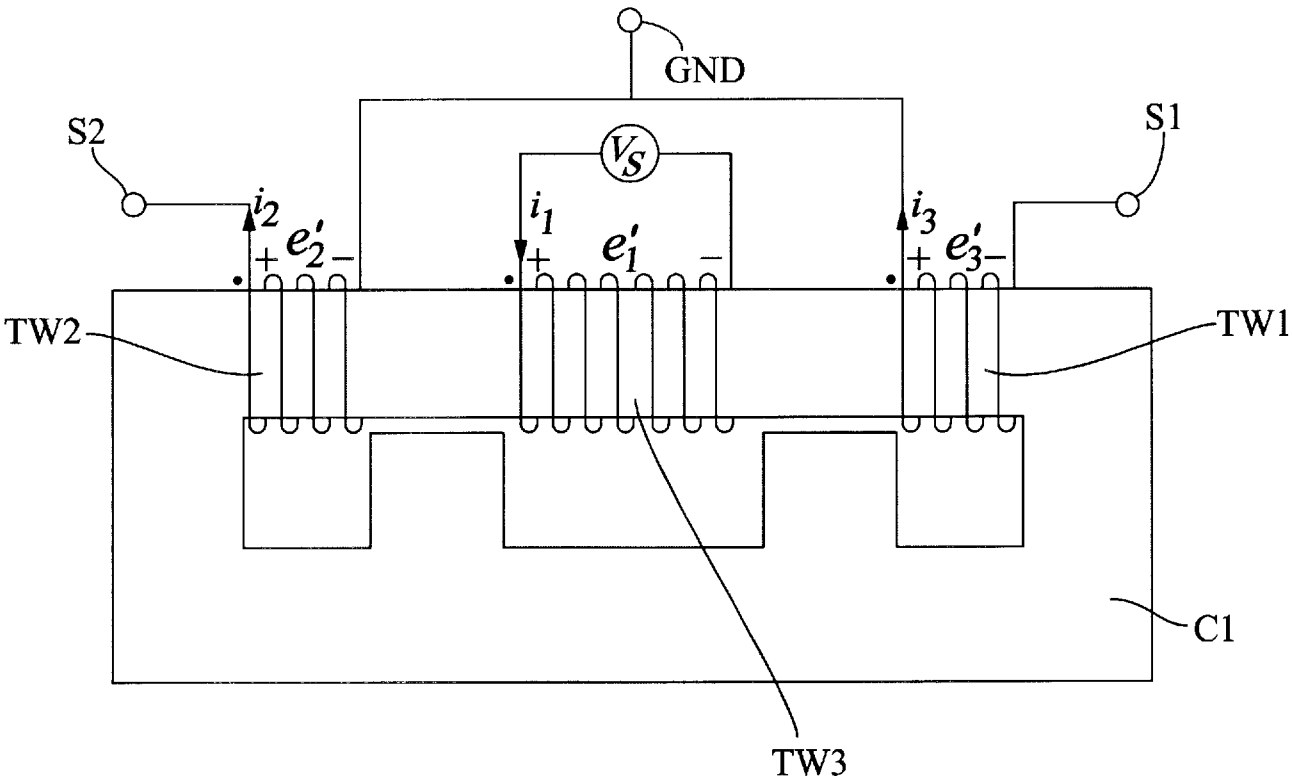
FIG. 4 (PRIOR ART)
FIG. 4 is a diagram of a prior art transformer winding construction for a midpoint grounded transformer.

Referring to FIG. 4, a diagram of a prior art transformer winding construction for a midpoint grounded transformer is shown. Primary winding TW3 along with secondary windings TW1 and TW2 are placed about core C1. Each winding is arbitrarily assigned a positive and negative terminal. The positive terminals have a dot placed near them. An AC source Vs with voltage el' is connected to the primary winding TW3 and generates a current I1 shown entering the positive terminal on TW3. Similarly, a current I2 is shown exiting the positive terminal on winding TW2 with a voltage e2' and a current I3 is shown exiting the positive terminal on winding TW1 with a voltage e3'. The positive terminal of winding TW2 is connected to terminal S2. The negative terminal of winding TW2 is connected to ground terminal GND. The negative terminal of winding TW1 is connected to terminal S1. The positive terminal of winding TW1 is connected to ground terminal GND. Here the two secondary coils produce output voltages that are 180° out of phase. This is also called a series aiding configuration. When the voltages are 180° out of phase, the potential difference between terminal S1 and S2 would be the sum of the voltages e2' and e3'.

Figure 5:
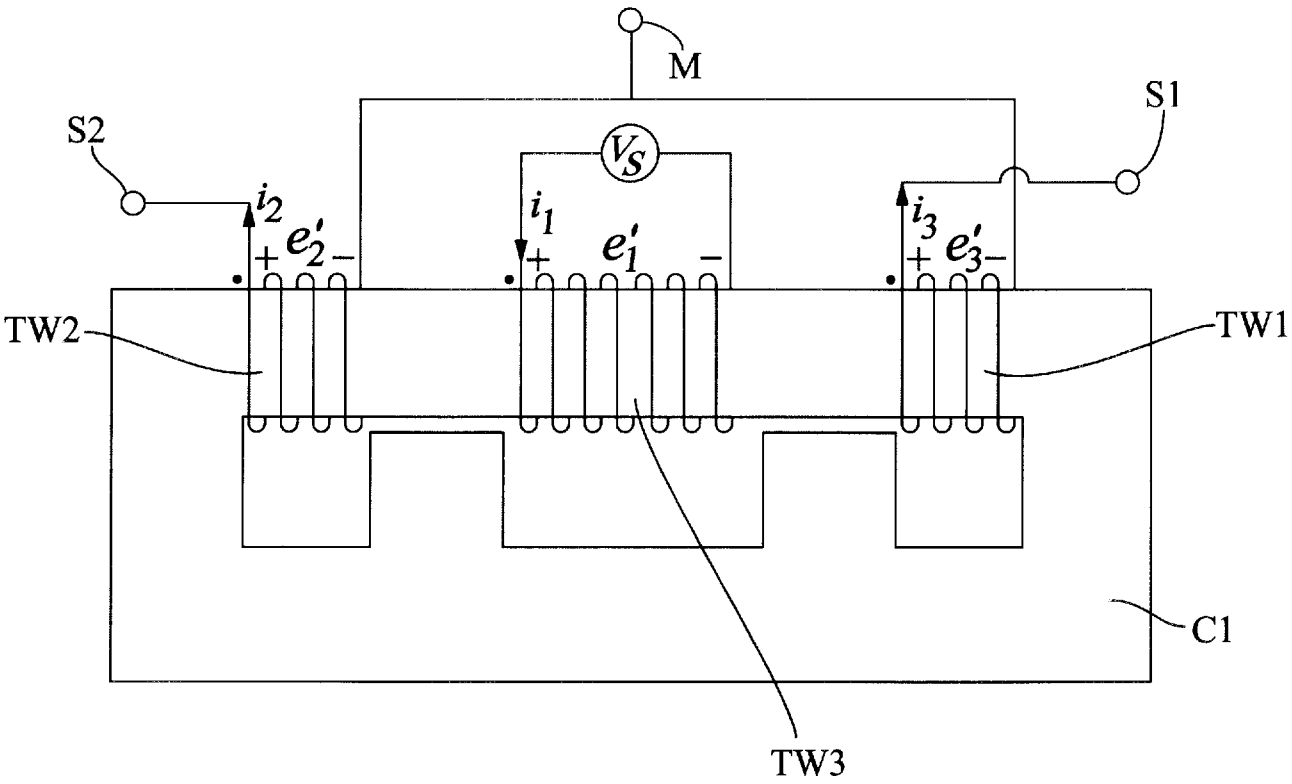
FIG. 5 is a diagram of the transformer winding construction of the present invention. It includes windings connected in phase and a mid point terminal M.

Referring to FIG. 5, a diagram of the transformer winding construction of the present invention is shown. FIG. 5 is similar to FIG. 4 except for now terminal M is connected in place of terminal GND and the terminals on winding TW1 are connected differently. The positive terminal of winding TW1 is connected to terminal S1. The negative terminal of winding TW1 is connected to terminal M. The secondary windings are arranged such that the two output voltage waveforms are in phase with respect to each other. Terminology for this is that the coils are wound in a series-opposing manner. When the voltages are 180° in phase, the potential difference between terminal S1 and S2 would be the sum of the voltages e2' and e3'. Here with the waveforms in phase, the voltages cancel and sum to zero.

The secondary windings could be wound in a bi-fillar manner with both of the coil wires placed next to each other and wound around the bobbin. Similarly, the secondary coils could be section wound on a bobbin in separate sections. The two output voltage waveforms are in phase with respect to each other and as such the potential difference between them is zero.

By utilizing an isolated mid-point connection of the secondary coils (brought out of the transformer by an insulated terminal M ), it is possible to operate the same luminous tubing load that would otherwise require a mid-point grounded transformer design.

Typically, an isolated transformer design is restricted to an output voltage of 7500 V. This is due to an UL industry design restriction of a maximum of 7500 V with respect to ground when any one output terminal is grounded. This design satisfies that requirement by utilizing output coils that are in phase with each other. With the proposed transformer design the following output conditions would exist:

1) Voltage from Output 1 to Terminal "M"—7500 V maximum
2) Voltage from Output 2 to Terminal "M"—7500 V maximum
3) Voltage from Output 1 to Output 2—~0 V When one output terminal is subjected to a Fault test in which one of the outputs is grounded, the following output conditions would exist:

1) If Output 1 is grounded:
   a) Voltage from "M" terminal to ground—7500 V maximum
   b) Voltage from Output 2 to ground—~0 V
2) If Output 2 is grounded:
   a) Voltage from "M" terminal to ground—7500 V maximum
   b) Voltage from Output 1 to ground—~0 V
2) If "M" is grounded.
   a) Voltage from Output 1 to ground—7500 V maximum
   b) Voltage from Output 2 to ground—7500 V This type of design will satisfy requirements for an isolated design that meets maximum voltage requirements to ground when a fault condition is introduced. This type of configuration also provides for a transformer design that can be used in mid-point connected applications operating footages previously operated only by mid-point grounded 15,000 V designs.

This isolated Gas Tube Power Supply of mid-point connected secondary coil design is capable of operating lamp lengths that typically require 15,000 volts to start the lamps without exceeding the maximum allowable voltages to ground when any one output terminal is grounded. It also satisfies industry requirements for Secondary Ground Fault Protection, while operating luminous tube footages that generally require 7500 V to 15000 V for proper operation. This design will improve neon transformer safety without the addition of costly circuitry. It will also provides a product for replacement and/or new installations that use mid-point connected tube loads without concern for nuisance tripping of a protection circuit. It provides for a cost effective method of meeting neon transformer safety requirements.

The present invention has been described in connection with a preferred embodiment. It will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. A transformer assembly for powering a plurality of gas discharge lamps, the lamps connected in a midpoint commoned lamp configuration, the assembly having a plurality of output terminals connectable to the lamps, the output terminals providing a high voltage to the lamps, the assembly comprising:

a transformer, the transformer having a primary winding and a plurality of secondary windings, the secondary windings connected to the output terminals, the secondary windings further having a midpoint terminal;

a housing, the housing containing the transformer;

input terminal means connected to the primary winding and operable to receive a source of power;

a ground terminal connected to a ground and to the housing;

a return terminal connected to the mid-point terminal and to the lamps and operable to provide a return path which is isolated from the earth ground such that a fault current does not flow from the output terminals to the ground.

2. The transformer assembly according to claim 1, wherein a first voltage between the output terminals and the ground terminal has a magnitude less than 7500 volts.

3. The transformer assembly according to claim 1, wherein a second voltage between the output terminals and the return terminal has a magnitude less than 7500 volts.

4. The transformer assembly according to claim 1, wherein a third voltage between the output terminals has a magnitude of zero volts.

5. The transformer assembly according to claim 1, wherein the secondary windings are wound in a series opposing configuration.

6. A method of preventing a fault current from occurring in a high voltage power supply powering a plurality of gas discharge lamps, the power supply connected to the lamps through a plurality of output terminals, the lamps connected in a midpoint commoned lamp configuration, the fault current flowing from the output terminals to a ground comprising the steps of:

(a) providing a transformer, the transformer having a primary winding and at least one secondary winding, the secondary windings connected to the output terminals, the secondary windings further connected to a midpoint terminal;

(b) inserting the transformer into a housing;

(c) connecting an input terminal means to the primary winding, the input terminal means operable to receive a source of power;

(d) connecting a ground terminal to the ground and to the housing;

(e) connecting a return terminal to the mid-point terminal and to the lamps, the return terminal providing a return path which is isolated from the ground such that the fault current is prevented from flowing from the output terminals to the ground.

7. The method according to claim 6, wherein a first voltage between one of the output terminals and the ground terminal has a magnitude less than 7500 volts.

8. The method according to claim 6, wherein a second voltage between one of the output terminals and the return terminal has a magnitude less than 7500 volts.

9. The method according to claim 6, wherein a third voltage between the output terminals has a magnitude of zero volts.

10. The method according to claim 6, wherein the secondary windings are wound in a series opposing configuration.

11. A transformer assembly for powering a plurality of gas discharge lamps, the lamps connected in a midpoint commoned lamp configuration, the assembly having a first and a second output terminal connectable to the lamps, the assembly comprising:

a housing;

input terminal means operable to receive a source of power;

a ground terminal connected to a ground and to the housing;

a transformer contained within the housing, the transformer having a primary winding and a first and a second secondary winding, the primary winding connected to the input terminal means, the first secondary winding connected to the first output terminal, the second secondary winding connected to the second output terminal, the first and the second secondary windings wound in a series opposing configuration;

a return terminal connected to the first and the second secondary windings, a first voltage existing between the first output terminal and the return terminal when the transformer is energized by the source of power, a second voltage existing between the second output terminal and the return terminal when the transformer is energized by the source of power, a third voltage existing between the first and the second output terminal when the transformer is energized by the source of power, the third voltage having a magnitude of zero volts, the return terminal operable to provide a return path which is isolated from the ground such that the fault current does not flow from the first or the second output terminal to the ground.

* * * * *